US009726003B2

(12) United States Patent
Pettapiece et al.

(10) Patent No.: US 9,726,003 B2
(45) Date of Patent: Aug. 8, 2017

(54) SYSTEMS AND METHODS FOR AUTOMATIC DRILLING OF WELLBORES

(71) Applicant: Ensign Drilling Inc., Calgary (CA)

(72) Inventors: Ronald Pettapiece, Calgary (CA); Wayne Kipp, Calgary (CA)

(73) Assignee: Ensign Drilling Inc., Calgary (CA)

( * ) Notice: Subject to any disclaimer, the term of this patent is extended or adjusted under 35 U.S.C. 154(b) by 568 days.

(21) Appl. No.: 14/014,293

(22) Filed: Aug. 29, 2013

(65) Prior Publication Data

US 2014/0060931 A1 Mar. 6, 2014

Related U.S. Application Data

(60) Provisional application No. 61/696,019, filed on Aug. 31, 2012, provisional application No. 61/729,244, filed on Nov. 21, 2012.

(51) Int. Cl.

| | |
|---|---|
| ***E21B 44/02*** | (2006.01) |
| ***E21B 44/00*** | (2006.01) |
| ***E21B 21/08*** | (2006.01) |
| *E21B 7/00* | (2006.01) |

(52) U.S. Cl.

CPC ..... *E21B 44/02* (2013.01); *E21B 21/08* (2013.01); *E21B 44/00* (2013.01); *E21B 7/00* (2013.01)

(58) Field of Classification Search

CPC ..... E21B 44/02; E21B 44/00; E21B 21/08
See application file for complete search history.

(56) References Cited

U.S. PATENT DOCUMENTS

| | | | | |
|---|---|---|---|---|
| 3,949,818 | A * | 4/1976 | Russell | E21B 3/02 166/377 |
| 4,875,530 | A * | 10/1989 | Frink | E21B 44/00 175/27 |
| 5,474,142 | A | 12/1995 | Bowden | |
| 5,713,422 | A | 2/1998 | Dhindsa | |
| 6,032,929 | A * | 3/2000 | Vatne | E21B 15/00 166/122 |
| 7,677,331 | B2 | 3/2010 | Lowe et al. | |
| 2007/0044465 | A1* | 3/2007 | Zhang | F15B 11/006 60/459 |
| 2010/0139981 | A1* | 6/2010 | Meister | E21B 7/04 175/61 |
| 2011/0098885 | A1* | 4/2011 | Iwami | B60G 9/022 701/37 |

OTHER PUBLICATIONS

Office Action dated Mar. 20, 2014 in CA Appln. No. 2826874.

* cited by examiner

*Primary Examiner* — David Andrews
*Assistant Examiner* — Kristyn Hall
(74) *Attorney, Agent, or Firm* — Stradley Ronon Stevens & Young, LLP

(57) ABSTRACT

The invention provides a system for automatic control of the drilling an oil well. The system includes an autodrilling interface enabling parameter input data to be input and enabling the display of system output data, a controller, a hydraulic control system and at least one sensor configured to the hydraulic control system. The controller receives parameter input data from the autodrilling interface and at least one sensor and provides output instructions to the hydraulic control system such that the hydraulic control system operates to control drilling based on controller instructions and sensor data.

7 Claims, 8 Drawing Sheets

SYSTEMS AND METHODS FOR AUTOMATIC DRILLING OF WELLBORES

RELATED APPLICATIONS

This application claims the benefit of U.S. Provisional Patent Application No. 61/696,019 filed Aug. 31, 2012, and U.S. Provisional Patent Application No. 61/729,244 filed Nov. 21, 2012, the entire contents of each of which is fully incorporated herein by reference.

FIELD OF THE INVENTION

The invention provides a system for automatic control of the drilling of an oil well. The system includes an autodrilling interface that enables parameter data to be input and output data to be displayed, a programmable logic controller (PLC), a hydraulic control system and at least one sensor configured to the hydraulic control system. The PLC receives parameter input data from the autodrilling interface and at least one sensor and provides output instructions to the hydraulic control system such that the hydraulic control system operates to control drilling based on PLC instructions and sensor data.

BACKGROUND OF THE INVENTION

Drilling a modern oil well involves the use of expensive and sophisticated heavy equipment that is complicated in its set-up and operation. As such, drilling an oil well also requires the skilled involvement of experienced and well trained operators to ensure that all aspects of the drilling process are executed efficiently and safely. Proper procedures at all steps of the process must be followed to prevent accidents, minimize the risk of damage to the equipment and also ensure that the actual drilling process is successful.

With regards to the drilling process itself, skilled operators manage the operation of the drilling equipment using established procedures and protocols to initiate the drilling process, monitor the drilling as it progresses and react to situations as they may occur. Due to the harshness of the environment and the complexities and variables ever present in drilling an oil well, it is well known that it is often difficult for the human operator to optimize the dynamic process as drilling continues. That is, the operator must generally balance a number of parameters in order to maintain effective and/or efficient drilling rates through particular formation rock while also operating within the performance specifications for the equipment involved. For example, the operator must monitor and control various parameters such as rate of penetration (ROP), weight on bit (WOB), drilling fluid flow rates, differential pressure (DP), motor speeds as well as other parameters during the drilling process.

As is known, adjusting the rate of release of the drillstring is one way in which the drilling process can be controlled. In controlling the rate of the release of the drillstring, the operator will be looking to control the amount of force that is being applied by the drillbit against the formation rock. That is, depending on the relative hardness of the rock the operator will look to optimize the drilling through that particular rock wherein the force being applied to the rock face is generally less than the total weight of the drillstring. Thus, the rate at which the drillstring is being lowered into the well bore must be controlled in order that the total force of the drill bit against the rock at the bottom of the well is maintained within desired ranges.

However, in many circumstances there is no quantitative measurement of downhole conditions. As such, the operator often conducts drilling operations based on "feel" that they may have developed over time from their experience in the field. However, while operator "feel" can be effective, it is only a qualitative determination of drilling performance and, as a result, presents significant risks to the operators in terms of operational efficiency of drilling as well as potentially increasing the risk of damaging drilling equipment.

Moreover, the situation becomes more complicated when drilling off-vertical or horizontal wells. In these types of wells, as the drillstring deviates from the vertical, the drillstring becomes at least partially supported by the formation. As such, the measured weight of the drillstring becomes difficult to measure at surface simply based on the hook load. As a result, in this type of well the WOB often cannot be accurately determined simply by measuring weight at surface. Moreover, as the driller may be required to apply a substantial downhole force on the drillstring simply to overcome the friction of the drillstring lying against the formation, the actual force being applied at the bit face may be substantially less than measured forces at surface. In other words, the measured value of downhole force as determined at the surface does not reflect the actual value of force that may exist at the drillbit.

As such, differential pressure (DP), measured as the difference in drilling fluid pressure between the motor and system pressure losses in a non-drilling state and the pressure with the bit against the formation, can be used as an effective parameter to determine the actual force being applied to the formation face by the drillbit. For example, a particular downhole motor may typically operate with a pressure of 1000 psi. The 1000 psi value may indicate that there is no force being applied on the drillbit at the formation face. In other words, a measured DP of 1000 psi simply indicates that the drillbit is spinning. However, as force is applied against the formation face, the required operating pressure to maintain optimum torque of the drillbit against the formation will increase as the resistance to drilling fluid flow increases due to the force of the drillbit against the formation face. Similarly, as drilling progresses and material is removed from the formation face, the force against the formation face will decrease which can be seen as a drop in pressure at surface. Thus, DP can be an effective parameter in determining how well drilling is progressing in some wells or at certain times of the drilling process.

In the past, in order to overcome these problems, autodrilling systems have been developed and utilized in order to at least partially automate the drilling process. In an automatic drilling process, drilling is controlled by equipment that typically obtains inputs from various sensors, feeds the input data to a controller that interprets the inputs and provides an output to drilling equipment.

Such systems, in various forms, have been applied to typical drilling equipment and specifically the hoist system of a drilling rig. The automatic control equipment is attached to the hoist system and its specific components such as a drawworks, drawworks brake and the cabling that controls the upward and downward motion of the drillstring. That is, in most rigs, the drawworks is activated to lift the drillstring and the drawworks brake is used to control lowering of the drillstring. Thus, in the traditional rig, no downward force above that of the weight of the drillstring can be applied to drillstring.

In other drilling systems no drawworks are used. In these systems, a hydraulic lifting system is utilized that allows both a lifting force and a downward force to be applied to the drillstring. Importantly, the downward force can be substantially higher than simply the weight of the drillstring as a downward hydraulic pressure can be applied to the drillstring. Such systems are effective in off-vertical wells.

In controlling the drilling process, the more parameters that can be effectively utilized within the drilling process, the more precisely the drilling process can be controlled with its attendant benefits on results but also decreased maintenance requirements if the equipment is being operated within preferred operational ranges.

A review of the prior art reveals that various automatic drilling systems have been developed in the past. For example, U.S. Pat. No. 7,713,442 teaches a system for drilling a borehole in which a first motor coupled to a drawworks is used to raise and lower a drill stem and a second motor rotates the drill stem. The system includes a control circuit that is coupled to the motors and sensors that obtain information including ROP, WOB, hook load and rotational speed. U.S. Pat. No. 5,474,142 describes an automatic drilling system that regulates drilling through a combination of drilling parameters on a drilling rig having a drawworks.

Accordingly, there continues to be a need for improved autodrilling systems and, in particular, for autodrilling systems that control a hydraulic hoist system on a rig with a broader range of potential control parameters.

SUMMARY OF THE INVENTION

In accordance with a first aspect of the invention, there is provided a system for automatically drilling an oil well comprising: an autodrilling interface having an input system enabling drilling parameter input data to be input and a display system enabling display of system output data during drilling; a controller operatively connected to the autodrilling interface; a hydraulic control system operatively connected to the controller and rig drilling equipment; at least one sensor configured to the hydraulic control system and the controller; wherein the controller receives parameter input data from the autodrilling interface and at least one sensor during drilling and provides output instructions to the hydraulic control system, the hydraulic control system operable to control drilling based on controller instructions and current sensor data.

In another embodiment, the parameter input data is a set point and includes any one of or a combination of rate of penetration (ROP), weight on bit (WOB) or differential pressure (DP) of a drilling fluid across a down hole drilling motor.

In a further embodiment, the autodrilling interface is a touchscreen having at least one input area enabling input data to be input and at least one display areas displaying output data.

In one embodiment, the display system displays any one of or a combination of current WOB, ROP or DP as measured from the at least one sensor during drilling and/or the display system displays any one of or a combination of set WOB, ROP and DP as set-points.

In another embodiment, the input system enables user activation of one or more drilling modes.

In yet a further embodiment, the at least one sensor includes any one of or a combination of a blind end pressure sensor and rod end pressure sensor operatively connected to the hydraulic control system for measuring the hydraulic pressure within a hydraulic control cylinder on the drilling rig. Further, the at least one sensor may include a differential mud pump pressure system and/or a position sensor operatively connected to the hydraulic control system for measuring the relative position of a hydraulic control cylinder on the drilling rig.

The system may also include a manual control interface operatively connected to the controller enabling manual control of the hydraulic control system.

In another aspect, the invention provides a method for automatically drilling a well with well drilling equipment, the well drilling equipment having a hydraulic control system for raising and lowering a drill string, a drilling fluid pump for circulating drilling fluid within the well and at least one sensor operatively connected to the hydraulic control system for measuring hydraulic pressure within the hydraulic control system, a controller and an autodrilling interface, wherein after manually setting at least one of rate of penetration (ROP), weight on bit (WOB) or differential pressure (DP) as one or more drilling parameters on the autodrilling interface and initiating drilling, the method comprising the steps of: a) monitoring and measuring current ROP, WOB and/or DP; b) increasing downhole hydraulic force if the WOB is below a set WOB value and decreasing downhole hydraulic force if the WOB is higher that a set WOB value; c) increasing the rate of lowering of the drillstring if the ROP is below a set ROP value and decreasing the rate of lower of the drillstring if the ROP is above a set ROP value; and/or d) increasing downhole hydraulic force if DP is lower than a set DP value and decreasing downhole hydraulic force if DP is higher than a set DP value.

In another embodiment, one of WOB, ROP or DP is set as a primary drilling parameter, and the method further includes the step of dynamically adjusting the primary parameter to one of WOB, ROP or DP not set as the primary drilling parameter during drilling if the primary drilling parameter cannot be maintained.

In one embodiment, ROP, WOB or DP are set as a primary set-point parameter within the PLC and priority is given to maintaining the primary set-point parameter while drilling is progressing.

BRIEF DESCRIPTION OF THE DRAWINGS

The invention is described with reference to the accompanying figures in which.

DETAILED DESCRIPTION OF THE INVENTION

With reference to the figures, systems and methods for automatically drilling oil wells are described. Importantly, the systems and methods described herein improve the efficiency of drilling as well as worker safety through the automation of parts of the drilling process.

Figure 1:
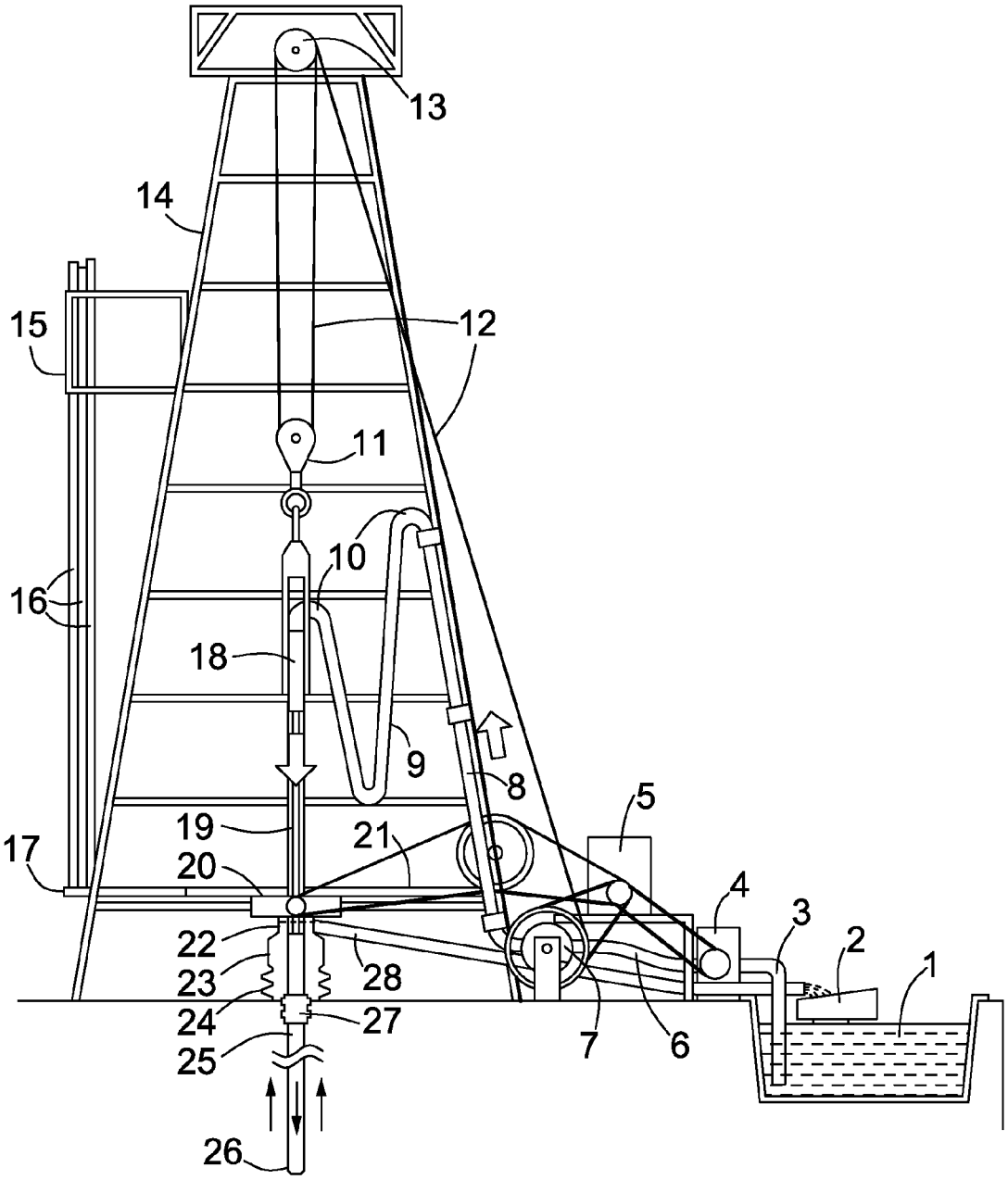
FIGURE 1 PRIOR ART
FIGS. 1 and 1A are schematic diagrams of drilling equipment utilized in accordance with the prior art.
Figure 1A:
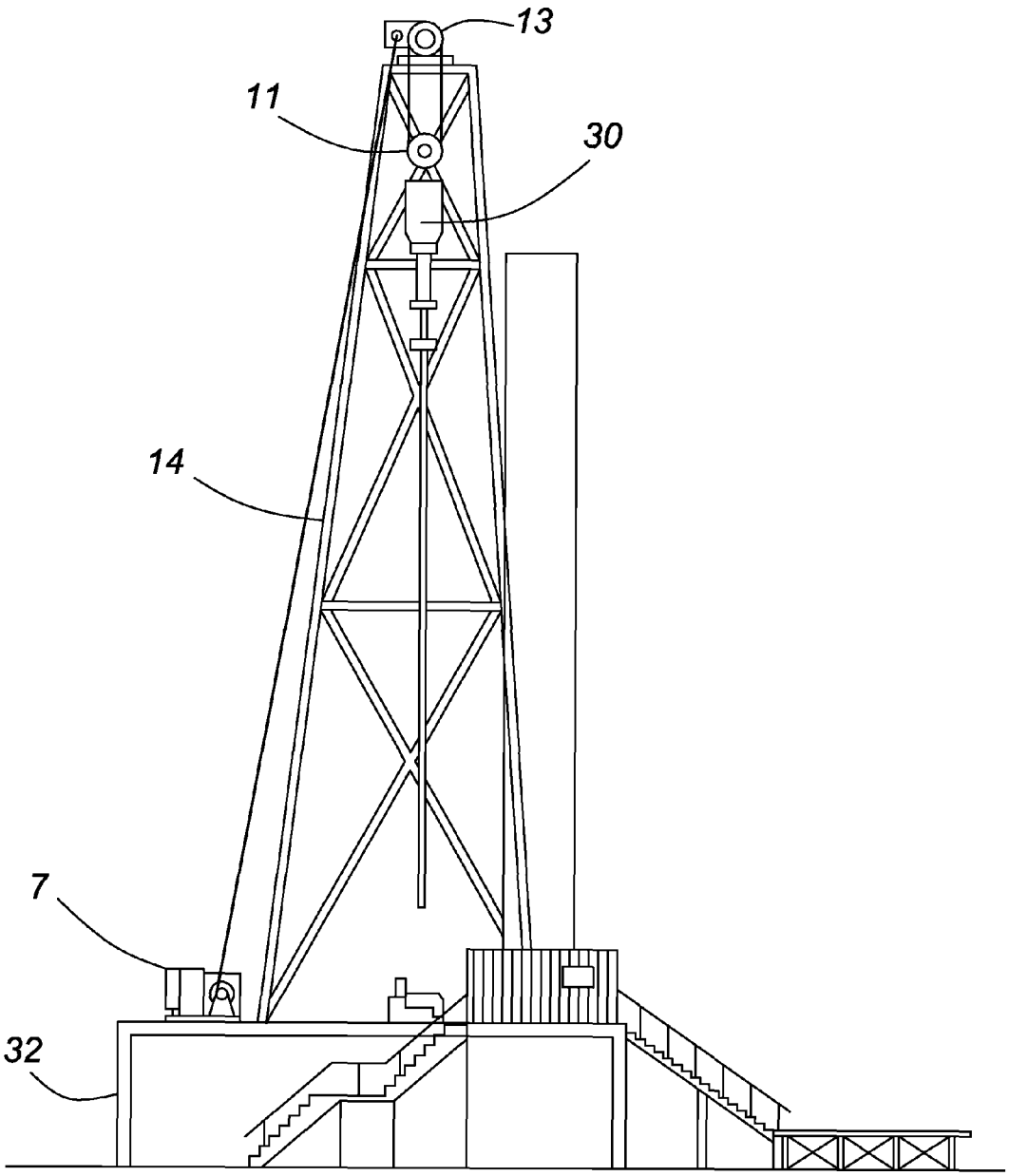
FIGURE 1A PRIOR ART

Typical drilling equipment is shown in FIGS. 1 and 1A. As shown, a typical drilling rig (FIG. 1) includes a derrick 14 for supporting the drilling equipment. The derrick is supported on a rig floor 17, 21 which also supports a stand 16 of drill pipe secured with a monkey board 15. As drilling progresses, drill pipe 16 is manoeuvred into position over the well bore and connected to the downhole drillstring 25 and thereafter rotated to effect movement of the drillbit 26 against the formation rock. During drilling, drilling fluid is pumped by mud pump 4 from mud tank 1 through suction line 3, vibrating hose 6, standpipe 8, Kelly hose 9 and gooseneck 10 to the top of the drillstring. The drilling fluid is pumped downwardly through the drillstring through drillbit 26 where it returns to surface within the annulus between the formation and drillstring. Upon returning to the surface, drilling fluid passes through a bell nipple 22 and flow line 28 where it is then passed over a shale shaker 2 that separates drilling fluid from drill cuttings.

Drill pipe is manoeuvred from the pipe stand by a travelling block 11, drill line 12, crown block 13 under the operation of drawworks 7 which is also used to both lift and lower the drillstring within the well bore. Drillpipe is secured to the drawworks by swivel 18 (or top works). A kelly drive 19 provides rotary force to the drillstring above rotary table 20.

In more modern systems, as shown in FIG. 1A a top drive system 30 is used to provide rotational force to the drillstring from the top of the drillstring. The top drive system is raised and lowered by a drawworks 7 on a substructure 32 through travelling block 11.

In each system, motors 5 provide power to the drawworks, mud pumps and drive systems. Wells also include blowout preventors (BOP) 23, 24 above casing head 27 as known.

Figure 1B:
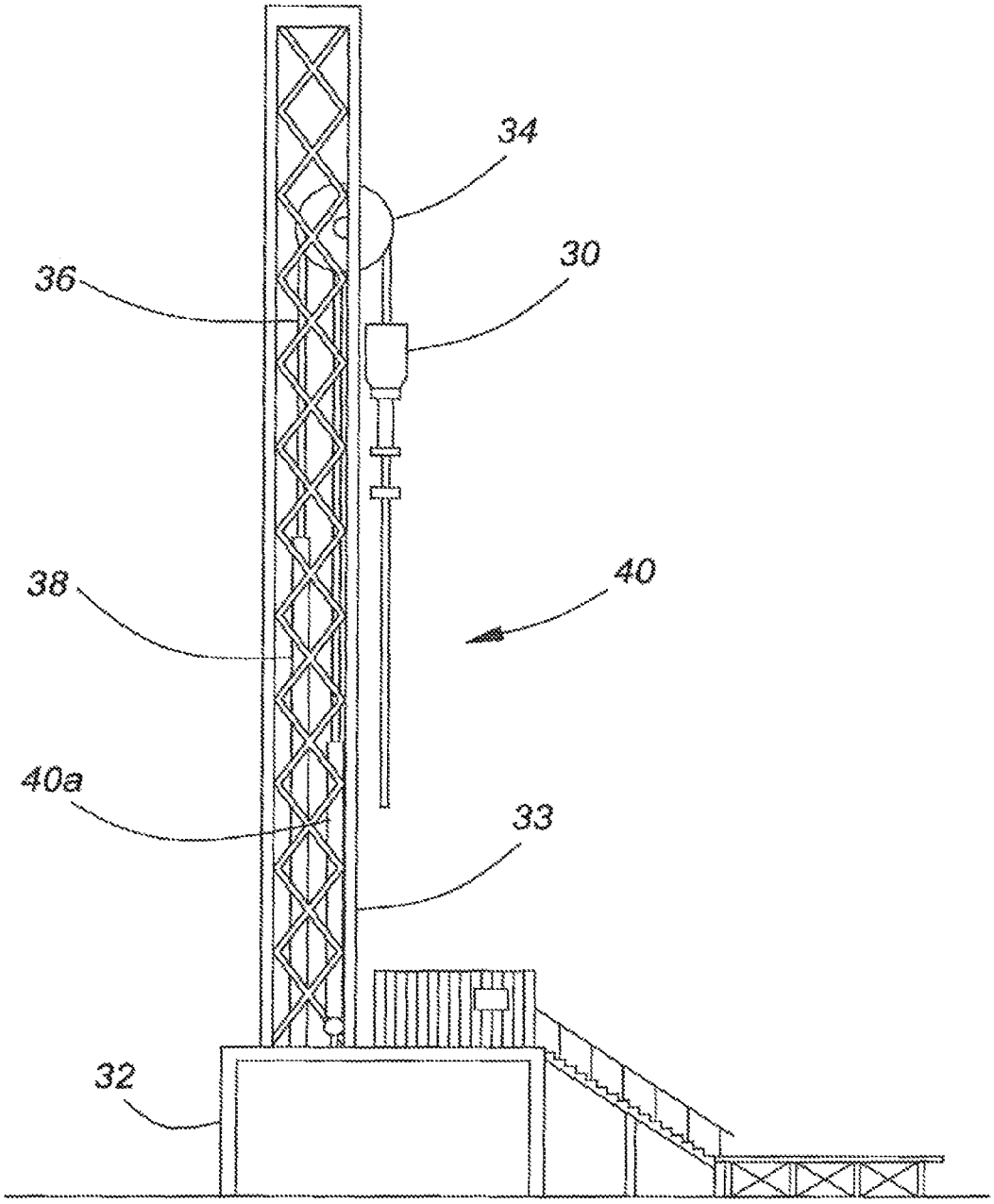
FIG. 1B is a schematic diagram of a top drive drilling rig utilizing the automatic drilling system in accordance with the invention.

In still other systems, drawworks lifting/lowering systems on the drilling rig are replaced with hydraulic hoist systems 40 with hydraulic cylinders 40*a* that control and manage lifting and lowering of the drillstring during drilling as shown in FIG. 1B. These systems generally include a mast 33, top drive 30, travelling crown 34, chain 36, and chain anchor 38 that collectively operate to enable drilling. In these systems, the mast 33 can be lighter than a conventional derrick as the mast is primarily used to guide the top drive 20. In addition, the rig is generally more compact as there is no drawworks behind the mast. Importantly, hydraulic hoist systems allow downhole pressures to be applied to the drillstring and/or the drill bit. In these systems, hoisting tonnage of the rig is transmitted through the base of the hydraulic cylinders and through the substructure 32. The ability to push downhole is particularly important in deviated or horizontal wells.

In accordance with the invention, systems and methods are provided to enable automatic drilling and more specifically to systems that electronically monitor and adjust hydraulic pressures in the hoist system of FIG. 1B, to monitor drillstring position, to monitor and control drilling fluid pump pressures and to otherwise control drillstring movement. Control of the hydraulic hoist system is based on sensor readings obtained at different locations in the drilling equipment and drilling fluid/mud pressures are measured at surface on the interior and annular sides of the drillstring.

In more specific embodiments, the technology provides a computer-controlled drilling system that obtains sensor input to determine operating parameters including weight on bit (WOB), rate of penetration (ROP) and/or differential mud pressure (DP), that automatically adjust hydraulic pressures in the hoist system to control drillstring movement, and drill bit rotation and adjust these parameters to optimize drilling performance. In these embodiments, the technology allows continuous monitoring and dynamic control over WOB, ROP and DP which overcomes the problem of an operator having to monitor and respond to multiple dynamic inputs from the drilling process.

Autodrilling System

Figure 2:
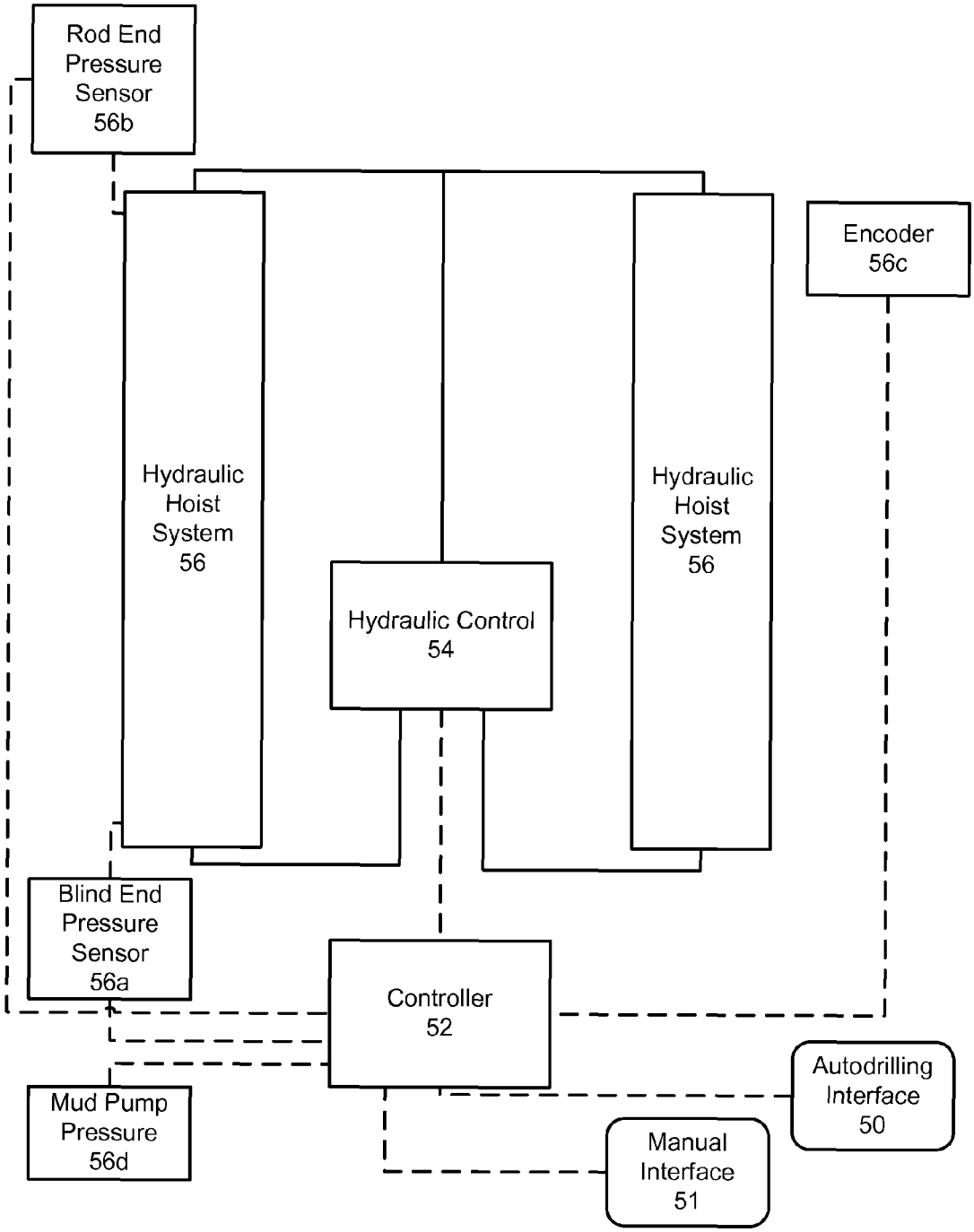
FIG. 2 is a generalized schematic overview of the hydraulic control system in accordance with one embodiment of the invention.

The autodrilling system generally consists of five subsystems as shown in FIG. 2 including a human-machine interface (HMI) or autodrilling interface 50, manual control interface 51, a controller 52 (such as a programmable logic controller (PLC), single board computer (SBC) or the like), hydraulic control system 54 and hydraulic hoist system 56. The manual control interface 51 enables basic manual control of the drilling system. The autodrilling interface 50 enables operator input to the system and displays system output information to the operator to enable autodrilling to be set up and to be controlled. The controller 52 receives and interprets operator input from either the autodrilling interface 50 or manual control interface 51 and provides output to the hydraulic control system 54 that in turn controls the operation of the hydraulic hoist system 56. Various sensors including a blind end pressure sensor 56*a*, rod end pressure sensor 56*b*, position encoder 56*c* and mud pressure sensors 56*d* are configured to the system to provide feedback to the controller and autodrilling interface for the control of the system hydraulics and for display and input to/by an operator.

Figure 2A:
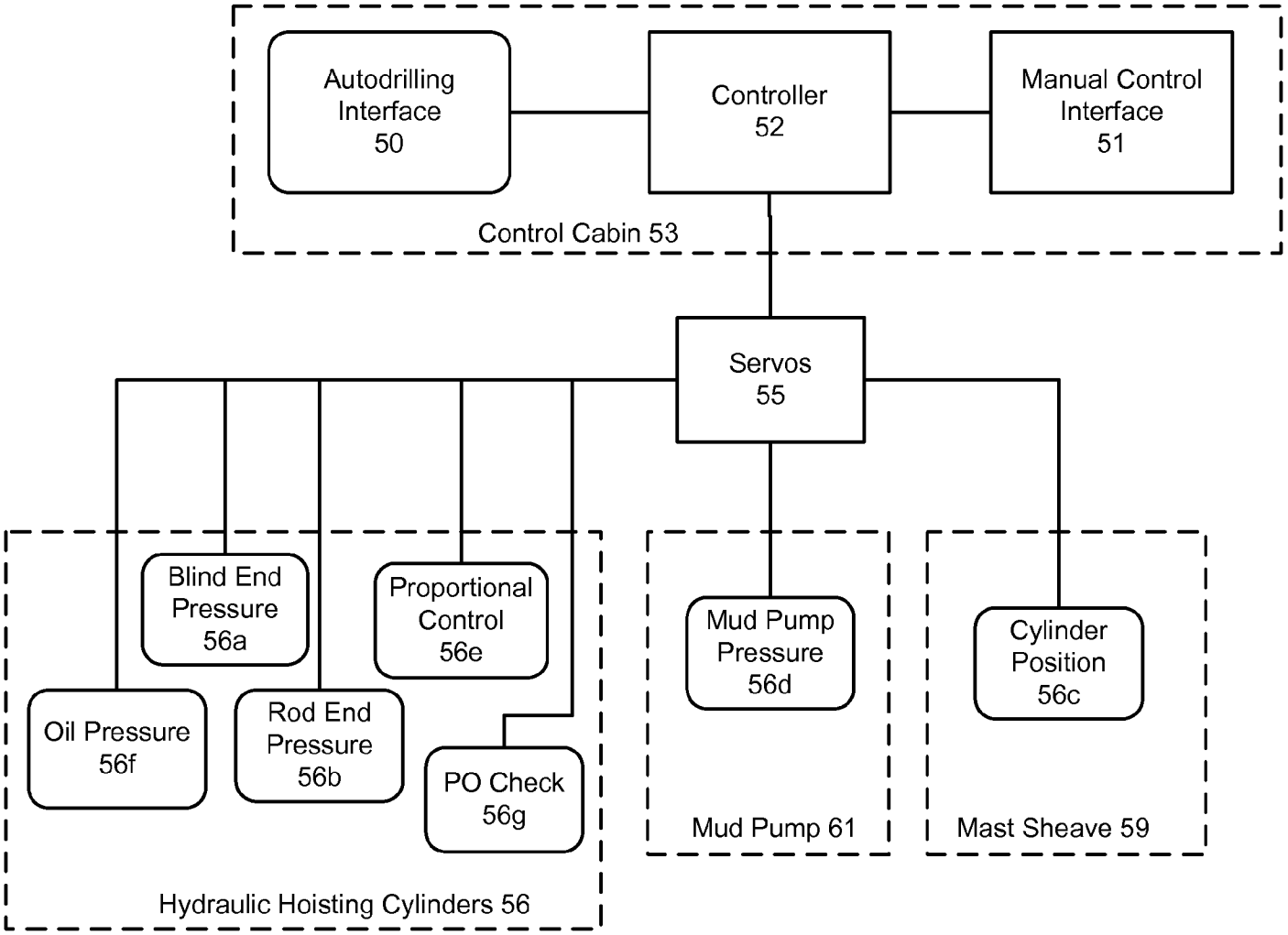
FIG. 2A is a schematic overview of the electronic control system and sensors in accordance with one embodiment of the invention.

FIG. 2A shows a more detailed layout of the system components in accordance with one embodiment. As shown, the autodrilling interface 50 is connected to the controller 52 which in turn is connected to a manual control interface 51 (or rig control panel) that would normally be present within a driller's control cabin 53. The controller is connected to a servo valve system 55 that controls the flow of hydraulic fluid within the hydraulics system and receives input from the various sensors for display on the autodrilling interface and/or display on the rig control panel. The servo valve system 55 is connected to the hydraulic hoisting system 56, a mast sheave system 59 and a mud pump system 61.

Typical sensors within the hydraulic hoisting system 56, mast sheave system 59 and mud pump system 61 include oil supply pressure 56*f*, cylinder blind end pressure 56*a*, cylinder rod pressure 56*b*, Pilot Operated check 56*g*, and cylinder hydraulic proportional control 56*e* sensors. The mud pump system 61 will typically include at least one mud pump pressure 56*d* sensor within the drillstring and the mast sheave will typically include a cylinder position 56*c* sensor. Collectively, the sensors provide feedback to the controller 52 for interpretation and to allow the controller to control system hydraulics to enable automatic drilling control. In addition, the controller will interpret the values obtained from each sensor and produce an alarm signal to the autodrilling interface and rig control panel in the event of a threshold event. For example, the oil pressure sensor 56*f* monitors the oil pressure in the hydraulic oil system. In the event that the PLC detects an oil pressure drop below a threshold value, the controller will produce an alarm signal to the autodrilling interface and rig control panel to signal the need for operator input. Preferably, the alarm signal is both a visual signal, such as a pop-up window on the autodrilling interface, and an audible signal.

Autodrilling Interface/HMI

Figure 3:
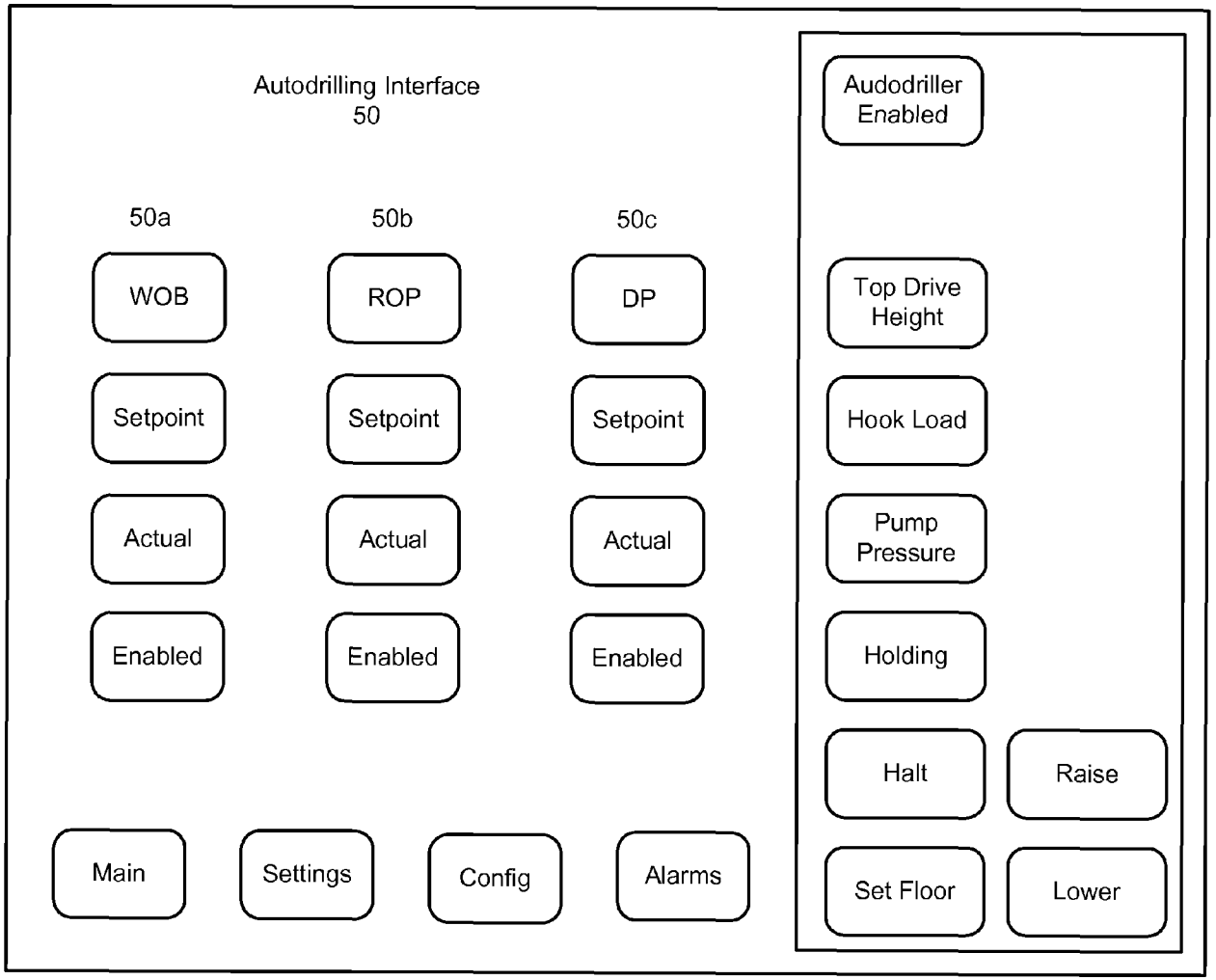
FIG. 3 is a representation of a human machine interface (HMI) in accordance with one embodiment of the invention.

In one embodiment, the autodrilling interface/HMI 50 is a touchscreen as shown in FIG. 3. The HMI generally allows the operator to set operational parameters to enable operation of the system as well as providing visual output to the operator regarding the operation and performance of the system. As shown, the autodrilling interface enables the operator to set parameters including weight on bit (WOB) 50*a*, rate of penetration (ROP) 50*b* and differential pressure (DP) 50*c*. For each parameter, a manually input set point can be entered with a further display of the actual or current measured value during autodrilling. In addition, the autodrilling interface may also provide visual output as to whether or not a particular parameter is enabled or not.

In operation, and as explained in greater detail below, for the primary function of enabling automatic drilling, the operator may enter a set point for one or more of the parameters and thereafter enable drilling. Thereafter, as automatic drilling is commenced, the controller will monitor feedback from the sensors and make adjustments to the hydraulic control systems to maintain drilling at the set points.

In addition, within the system, there are preferably multiple modes of operation. In each mode, values (or ranges) for the one or more of the parameters can be set and the system will seek to control drilling such that drilling progresses within the set ranges. Each parameter can be set as a primary parameter, with the remaining parameters not set or set as secondary or tertiary parameters. Thus, with the three parameters, 13 modes of operation are possible based on the various possible combinations of the parameters wherein one of the parameters is always a primary parameter and the secondary and tertiary parameters are optional.

TABLE 1

Possible Parameter Combinations

| Primary | Secondary | Tertiary |
|---|---|---|
| WOB | | |
| ROP | | |
| DP | | |
| WOB | ROP | |
| WOB | DP | |
| ROP | WOB | |
| ROP | DP | |
| WOB | ROP | DP |
| WOB | DP | ROP |
| ROP | WOB | DP |
| ROP | DP | WOB |
| DP | ROP | WOB |
| DP | WOB | ROP |

Generally, only one parameter will control the drilling sequence at a given time. If the operator wishes the control system to ignore a parameter, then the parameter can be set as "disabled" and thereby be displayed as a disabled parameter on the main screen. In the event that the set parameter has a malfunction, such as a feedback sensor failing, then the system will stop and hold the load. The operator may then disable the parameter and allow control either manually or through other working control routines.

The autodrilling interface also allows operator input to provide manual control of the system to prepare the drilling equipment for autodrilling. Such input includes the ability to raise or lower the drill string, set the pump pressure or stopping all operations. In addition, other parameters may be displayed back to the operator including for example, pump pressure, hook load and/or top drive height.

Operation

Figure 4:
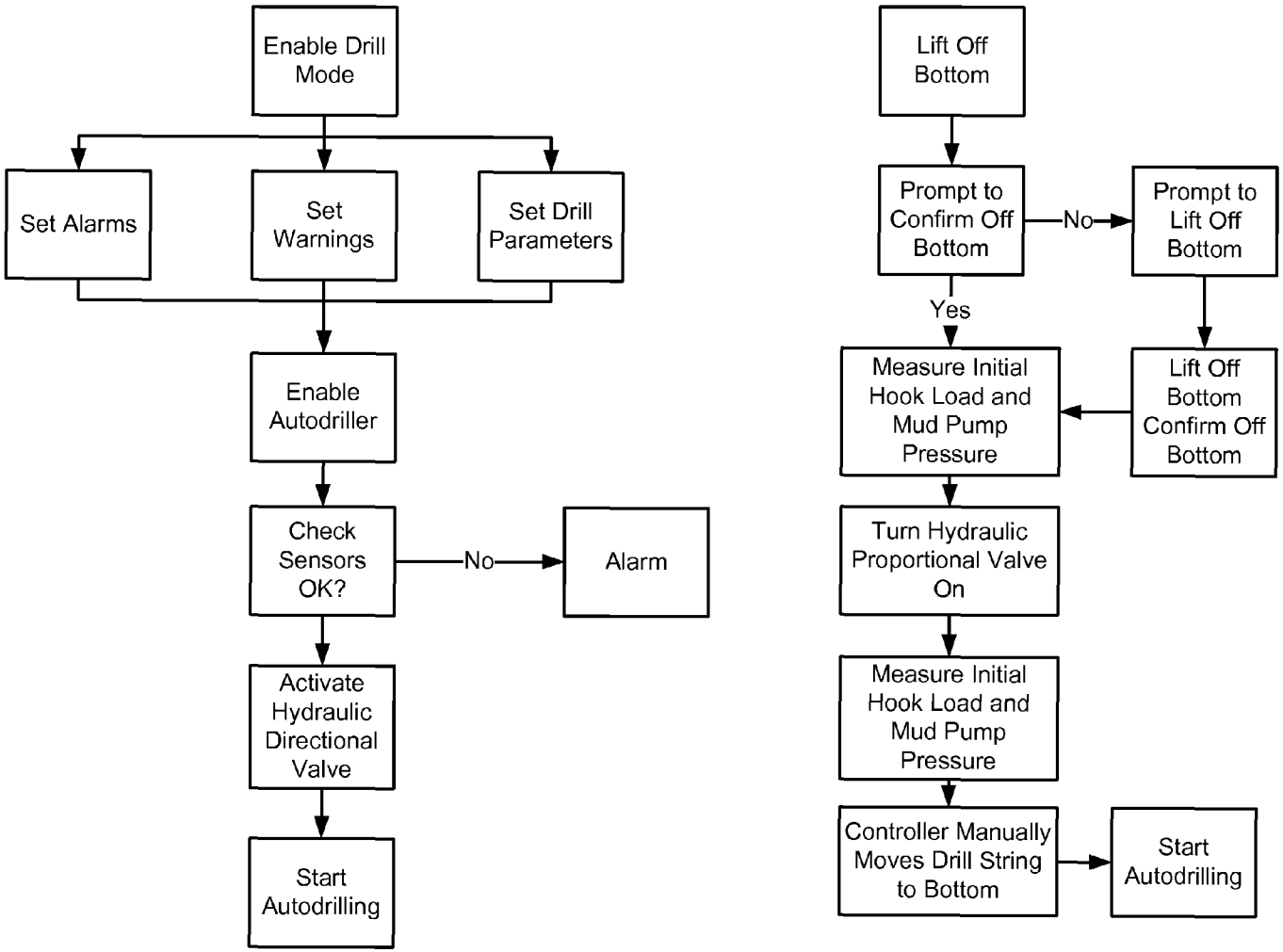
FIG. 4 is a representative process flow diagram in accordance with one embodiment of the invention; and, FIG. 5 is a representative flow chart detailing the logic of the primary functions of the hydraulic control system in accordance with one embodiment of the invention.

With reference to FIGS. 4 and 4A, the system is generally operated as follows:

Initially, the operator will enable "Drill Mode" on the autodrilling interface. The operator will enter desired alarm and warning settings as well as set the drill parameters. After the desired settings and parameters have been entered, the operator will enable the autodrilling system which will then perform a sensor check to ensure the system sensors are operating properly. If the sensor check is ok, the hydraulic system will be activated for drilling. If the sensor check returns an error, an alarm signal will be presented to the operator.

Once the operator has received verification that the hydraulic system has been activated, the operator will be prompted to start autodrilling.

In one embodiment, the autodrilling process will start by prompting the operator to lift the drillstring off bottom. In this case, using the lift buttons on the autodrilling interface, the operator will lift the drillstring off the bottom.

Alternatively, the autodrilling interface will automatically lift the drillstring off bottom after actuation of the hydraulic system. Automatic lifting may be achieved by the system measuring the current hookload, initiating lifting and monitoring the hookload and/or rate of change of hookload.

In the manual case, the autodrilling interface will then prompt the operator to confirm that the drillstring is off bottom. If the drillstring is confirmed as being off bottom, the system will measure the hookload and the mud pump pressure while off bottom as baseline values. Alternatively, the autodrilling interface will give the operator the option of manually entering the hookload and/or stringweight. The system will then begin to lower the drillstring towards the bottom in a controlled manner based on the ROP settings, if activated, or at a fixed rate.

As the WOB increases as a result of contacting the bottom, the system will operate to drill within the set parameters. While drilling is underway, when a parameter value is reached, that value will be capped. For example, for a given set WOB value, the system will continue to lower the drillstring such that the measured WOB will be less than the set value. If ROP is set as well, the system will be simultaneously measuring the WOB and ROP values. If the WOB maximum value is reached and the ROP value is not reached, the WOB value will be maintained but not exceeded.

Similarly, in the event that the ROP value is reached, for example if drilling through a soft formation, the system will hold the ROP value but allow the WOB value to drop. If drilling conditions change, and the ROP value is not being met the WOB will increase. If the system cannot maintain these conditions during the course of the drilling sequence the system will notify the operator and new weight on bit, rate of penetration, and differential pressure settings may need to be entered. Generally, the system will operate to ensure that drilling progresses smoothly.

During drilling, the system will normally be able to provide hands-off control while the system may be encountering dynamic changes in the drilling conditions such as changes in formation conditions. However, for safety reasons, the system will shut-down if as a maximum value is reached, the system cannot maintain the parameter in question below the set value.

In addition, autodrilling will stop if any shutdown input is received from another source, such as an emergency shutdown input, control cabin manual input (e.g. joystick movement), a major rig shutdown event and/or a self-diagnostic alarm that may be generated from within the autodrilling system. In the event that a shutdown event does occur, the autodrilling process can be re-initiated as described above. Alternatively, the autodrilling process can be continued from where it stopped drilling without having to re-initiate the drilling process from the start.

The autodrilling system also includes a floor saver system to provide appropriate feedback to the driller regarding the position of the travelling assembly. That is, as the travelling assembly reaches various levels during drilling, warnings are provided to the operator to indicate that different levels have been reached. Higher warning levels may be manually set depending on the particular dimensions of a specific rig but all will generally include a hard shut-off system at the lowest level to prevent damage to rig surface equipment. Upon completion of drilling with the current section of drill string, the operator can either use the autodrilling interface or the manual drill rig controls to lift the top drive in preparation for the next section of drillstring.

Figure 5:
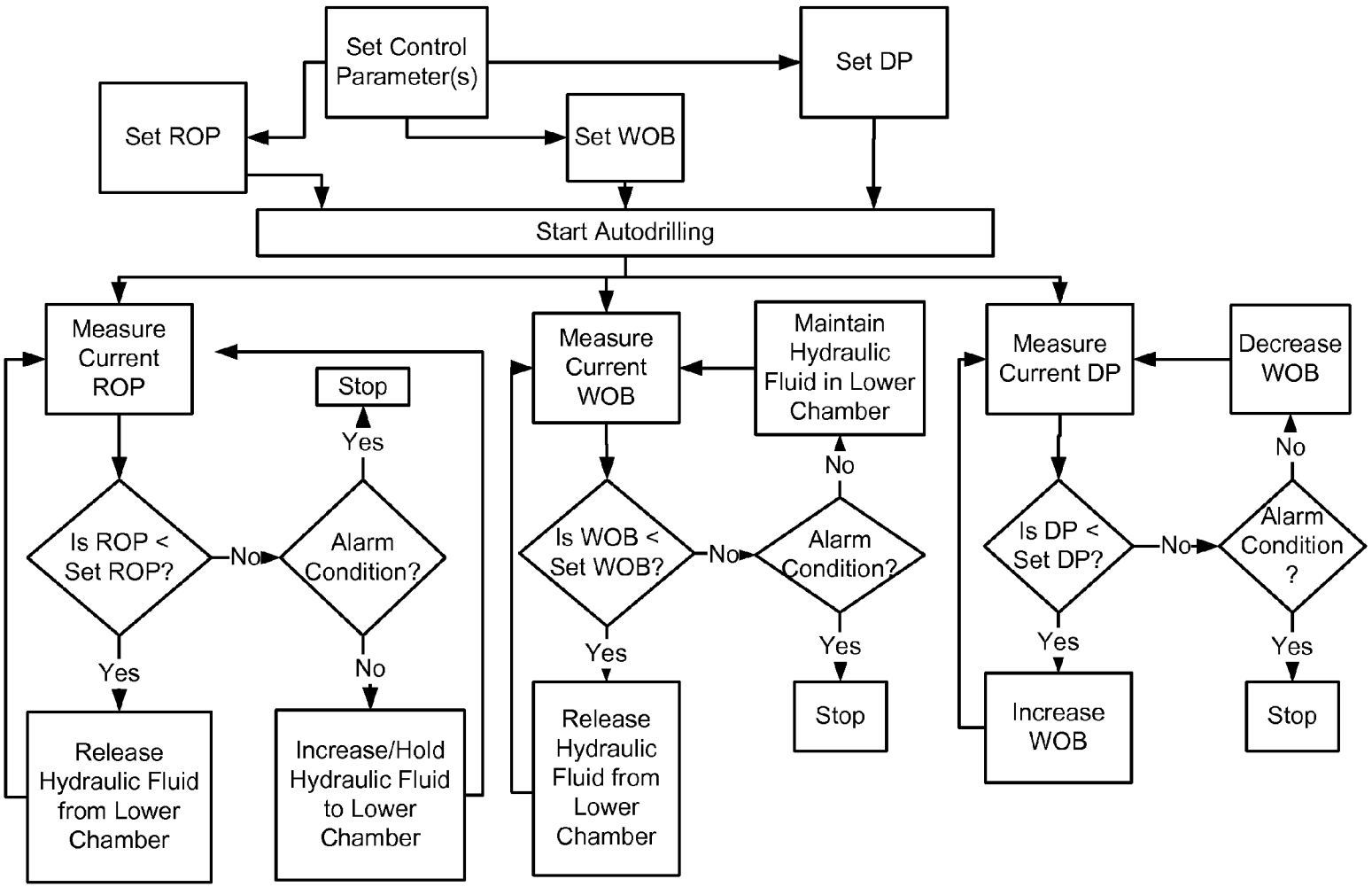

A representative flow chart of the decision making processes of the autodrilling system is shown in FIG. 5 for the different parameters if set.

As shown, if ROP is set and autodrilling has commenced, the system will measure the current ROP. If the ROP is less than the set ROP, ROP may be increased by releasing hydraulic fluid from the lower chamber of the rig's hydraulic cylinders such that the WOB is increased. In the case of a horizontal or deviated well this may also require an increase in hydraulic pressure at the top of the hydraulic cylinders. The system will then re-measure the current ROP and the loop will repeat. If the ROP is not less than the set ROP and no alarm condition exists, the system will increase or hold hydraulic fluid pressure within the lower chamber of the rig's hydraulic cylinders.

Similar routines are followed for set WOB and DP as shown in FIG. 5.

Differential Pressure

In the context of the technology, differential pressure (DP) is the measured difference in drilling mud pressure before loading and after the drill bit has contacted the formation face, and variations in the differential pressure are indicative of a change in the downhole conditions, such as a harder formation. This change is registered by sensors at surface that relay this information to the controller which then calculates the optimum rate at which to drill.

Generally, if the measured DP value increases, indicating that flow of drilling fluid through the drill bit is more difficult (i.e. reduced), possibly due to a harder formation, the system may decrease or hold the WOB to allow the formation to be drilled and thereby increase drilling fluid flow rates through the bit. If the DP value decreases indicating rapid flow through the drill bit, the WOB may be increased.

Other System Features

Other features of the system may include the ability to work in multiple modes simultaneously. In this embodiment, the system will monitor the different drilling parameters namely two or more of WOB, DP and ROP as drilling is progressing. If one of the set points of one of the drilling parameters is reached, that one drilling parameter becomes the controlling parameter wherein the other parameters will be varied to maintain the controlling parameter at its set point. Thus, if under drilling conditions, the controlling parameter cannot be maintained, then the controlling parameter may then dynamically change.

For example, WOB and ROP may be enabled. WOB is set at 10,000 daN and ROP is set at 100 meters/hour. Initially, the drill bit is working in hard material and the controlling WOB of 10,000 daN is obtained but the ROP is only 50 m/hour. Thereafter, the drill bit encounters a softer formation and with a 10,000 daN WOB, the ROP increases to 100 m/hour. In this case, the ROP will be automatically held at 100 m/hour and the WOB would be reduced or held to ensure the ROP is not exceeded.

In another example, each of WOB, ROP and DP may be enabled. WOB is set at 10,000 daN, ROP is set at 100 meters/hour and DP is set at 1100 psi. In a hard formation, the WOB may be reached but, as above, the ROP is not reached and the DP is only 1050 psi. In this case, the system may then increase the WOB to increase the DP value in an attempt to increase the ROP.

In a horizontal or deviated formation, WOB may not be able to be set or measured accurately and thus, the operator may choose to engage DP as the primary drilling parameter.

In addition, the system may also have the ability to change values while active, set alarm condition ranges and the ability to save parameter combinations as preferred drill modes.

For example, the system will allow different drilling modes to be created that may be designed or set by the operator. For example, drilling modes such as "lateral rotate", "lateral slide", "build rotate", "build slide", etc. may be created and saved by the operator. Each of these drilling modes may be created based on an operator's experience in a given type of formation.

With respect to the alarm system, for each parameter, the alarm system may include/require the ability to set any one of or a combination of maximum values, an alarm value, a warning value, a set point and/or a minimum value. Such alarm conditions may be set and saved for each drill mode. The system may also include maximum or minimum parameters that cannot be overridden by the operator for safety reasons.

The system may include a modem interface to enable all data from the system to be returned to a central server.

As known to those skilled in the art, the system may also include the ability to set scaling parameters for different sensors to enable appropriate calibration. Similarly, the floor saver values may be set from within the autodriller system.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. An autodrilling system for a drilling rig with a hydraulic cylinder-driven hoist system having at least one hydraulic cylinder, the autodrilling system comprising:

an autodrilling interface having an input system configured for input of drilling parameter settings including rate of penetration (ROP), weight on bit (WOB) and differential pressure (DP) of drilling fluid across a drill bit, and a display system enabling display of system output data during drilling;

a controller operatively connected to the autodrilling interface;

a hydraulic cylinder control system for raising and lowering a rotary drill string, the hydraulic cylinder control system operatively connected to the controller, the hydraulic cylinder and a mud pump;

any one of or a combination of a blind end pressure sensor and a rod end pressure sensor operatively connected to the hydraulic control system for measuring the hydraulic pressure within the hydraulic cylinder; and a combination of sensors for calculation of differential mud pressure upstream and downstream of a mud motor;

wherein the controller is configured to compare one or more of the drilling parameter settings with one or more of the current ROP, WOB and DP and to provide output instructions to the hydraulic cylinder control system to automatically control drilling by adjusting the function of the hydraulic cylinder and the mud pump to adjust one or more of the current ROP, WOB and DP to maintain the drilling parameter settings.

2. A system as in claim 1 wherein the autodrilling interface is a touchscreen having at least one input area enabling input data to be input and at least one display areas displaying output data.

3. A system as in claim 1 wherein the input system enables user activation of one or more drilling modes where a drilling mode includes pre-set drilling parameters.

4. A system as in claim 1 wherein the sensors include a position sensor operatively connected to the hydraulic control system for measuring the relative position of a hydraulic control cylinder of the rig drilling equipment.

5. A system as in claim 1 further comprising a manual control interface operatively connected to the controller enabling manual control of the hydraulic control system.

6. A method for the automated drilling of an oil or gas well with well drilling equipment, the well drilling equipment having a hydraulic cylinder control system for raising and lowering a rotary drill string, a drilling fluid pump for circulating drilling fluid within the well and a plurality of sensors configured to measure hydraulic cylinder pressure data and drilling fluid pressure data and transmit the pressure data to the controller for calculation of current weight rate of penetration (ROP), weight on bit (WOB) and differential pressure (DP), a controller and an autodrilling interface, wherein after manually setting at least one ROP, WOB or DP as one or more drilling parameters on the autodrilling interface and initiating drilling, the method comprises the steps of:

a. monitoring and measuring current ROP, WOB and DP;

b. increasing downhole hydraulic force if the WOB is below a set WOB value and decreasing downhole hydraulic force if the WOB is higher that a set WOB value;

c. increasing the rate of lowering of the drillstring if the ROP is below a set ROP value and decreasing the rate of lower of the drillstring if the ROP is above a set ROP value; and/or d. increasing downhole hydraulic force if DP is lower than a set DP value and decreasing downhole hydraulic force if DP is higher than a set DP value.

7. A method as in claim 6 wherein one of WOB, ROP or DP is set as a primary drilling parameter, the method further comprising the step of dynamically adjusting the primary parameter to one of WOB, ROP or DP not set as the primary drilling parameter during drilling if the primary drilling parameter cannot be maintained during drilling, thereby automatically adjusting the control system to achieve the set ROP value, the set WOB value or the set DP value.

* * * * *